US005085980A

United States Patent [19]

Aono et al.

[11] Patent Number: 5,085,980

[45] Date of Patent: Feb. 4, 1992

[54] PHOTOGRAPHIC ELEMENT CONTAINING WATER-ABSORBING COMPOUND

[75] Inventors: Toshiaki Aono; Koichi Nakamura; Takeshi Shibata, all of Kanagawa, Japan

[73] Assignee: Fuji Photo Film Co., Ltd., Kanagawa, Japan

[21] Appl. No.: 667,368

[22] Filed: Mar. 12, 1991

Related U.S. Application Data

[63] Continuation of Ser. No. 344,524, Apr. 26, 1989, abandoned, which is a continuation of Ser. No. 811,859, Dec. 20, 1985, abandoned.

[30] Foreign Application Priority Data

Dec. 28, 1984 [JP] Japan ..... 59-277778

[51] Int. Cl.[5] ..... G03C 1/06

[52] U.S. Cl. ..... 430/531; 430/533; 430/631; 430/941; 430/961

[58] Field of Search ..... 430/531, 533, 631, 941, 430/961

[56] References Cited

U.S. PATENT DOCUMENTS

| | | | |
|---|---|---|---|
| 3,179,517 | 4/1965 | Tregillus et al. | 430/404 |
| 3,930,859 | 1/1976 | Corrigan | 430/404 |
| 4,015,043 | 3/1977 | Watanabe et al. | 428/342 |
| 4,102,842 | 7/1978 | Fujimoto et al. | 524/561 |
| 4,155,893 | 5/1979 | Fujimoto et al. | 524/561 |
| 4,480,025 | 10/1984 | Chang et al. | 430/206 |
| 4,517,244 | 5/1985 | Kobayashi et al. | 428/342 |
| 4,547,451 | 10/1985 | Jasne et al. | 430/215 |
| 4,552,835 | 11/1985 | Nakamura et al. | 430/523 |
| 4,605,608 | 8/1986 | Bullitt | 430/206 |
| 4,629.677 | 12/1986 | Katoh | 430/215 |
| 4,722,885 | 2/1988 | Tokoyama et al. | 430/531 |

FOREIGN PATENT DOCUMENTS 52-102712 8/1977 Japan .

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A photographic element is disclosed comprising a support having provided thereon a highly water-absorbing high molecular weight compound having degree of swelling of 5 or more.

16 Claims, No Drawings

PHOTOGRAPHIC ELEMENT CONTAINING WATER-ABSORBING COMPOUND

This is a continuation of application Ser. No. 07/344,524 filed Apr. 26, 1989 now abandoned, which is a continuation of application Ser. No. 06/811,859 filed Dec. 20, 1985, now abandoned.

FIELD OF THE INVENTION

This invention relates to a photographic element, and more particularly, to a photographic element which requires a shorter processing time for forming a final image.

BACKGROUND OF THE INVENTION

Various photographic elements have been known for forming images. For example, there are silver halide black-and-white photographic light-sensitive materials to be processed by wet processing, coupler-process silver halide color photographic light-sensitive materials, silver-dye bleach color photographic light-sensitive materials, color diffusion transfer process photographic light-sensitive materials, etc., and, in addition, a combination of (1) a heat-developable color light-sensitive material comprising light-sensitive silver halide and a dye-providing substance capable of producing or releasing a diffusible hydrophilic dye as a function (direct or inverse) of the reduction reaction of the light-sensitive silver halide to silver by heat development and (2) a dye-fixing material for transferring and fixing the dye in the presence of a small amount of water, described in U.S. Pat. Nos. 4,500,626, 4,483,914, etc.

An increasing demand has recently existed to shorten the processing time required for obtaining a final image using such photographic elements. That is, with black-and-white photographic light-sensitive materials forming silver images, it has been required, particularly with medical X-ray films for which rapid processing is of importance, to accelerate development processing for obtaining desired maximum image density in a short time, and, with color photographic light-sensitive materials, improvements in accelerating desilvering have been desired as well as acceleration of development processing. Furthermore, with color diffusion transfer light-sensitive materials, the shorter the time from photographing to formation of final image, i.e., the shorter the time of development and transfer of dye image, the greater the commercial merit of the materials, Similarly, in the color image-forming process of heat-development type, it is desirable to accelerate transfer of a hydrophilic dye to a dye-fixing material in the presence of water.

In order to meet the above-described requirements, it has heretofore been employed to soften the coating film (usually gelatin film) of a photographic element in order to enable to processing solutions such as a developer, a bleaching solution, a fixing solution, water for image transfer, etc., to readily permeate into the film. However, when hardening degree of gelatin is reduced or a hydrophilic colloid such as polyvinyl alcohol, polyvinylpyrrolidone, dextran, or the like is added together with gelatin for the purpose of softening the film, the time required for absorbing water is not necessarily shortened, though a somewhat large swelling (due to the amount of water being contained in the film) is obtained. In addition, there arises a problem of deterioration of mechanical strength of the coating film and a problem of a contraction of the coating surface, called reticulation, in the drying step after photographic processing.

SUMMARY OF THE INVENTION

It is, therefore, an object of the present invention to provide a photographic element which can provide a final image in a shorter time without reduction of mechanical strength of the coating film and without the problem of reticulation, etc.

The above-described objects of the present invention have been attained by a photograhic element comprising a support having provided thereon a highly water-absorbing high molecular weight compound having degree of swelling for water of 5 or more.

DETAILED DESCRIPTION OF THE INVENTION

In the present invention, the "degree of swelling" refers to the value of (thickness of swollen film)/(thickness of dry film) measured with a water-insoluble coating film of a high molecular compound (e.g., gelation or a highly water-absorbing high molecular weight compound of the present invention) (having been rendered, if necessary, water insoluble with a crosslinking agent and/or by curing) using water. Herein, measurement of the degree of swelling was conducted according to the process described in *Photographic Science Engineering*, Vol. 16, p. 449 (1972). In the present invention, a layer of a highly water-absorbing high molecular weight compound having a degree of swelling of 5 or more, and preferably 10 or more, or a layer containing the high molecular weight compound dispersed in an other hydrophilic layer such as gelatin is provided on a support. Such layer has the ability that, even when hardened with a crosslinking agent and/or by curing for attaining sufficient mechanical strength, it can rapidly absorb a large amount of a photographic processing solution such as a developer, a fixing solution, a bleaching solution, a bleach-fixing solution, water for dye transfer, etc., to swell, and hence it enables smoothly and rapidly conducting photographic processing steps as development, desilvering, dye transfer, etc. In addition, the layer causes no reticulation upon drying after the photographic processing.

Preferable examples of the highly water-absorbing high molecular weight compound include saponified products of copolymers composed of at least vinyl ester and ethylenically unsaturated carboxylic acid or derivatives thereof as described in Japanese Patent Application (OPI) Nos. 14689/77, 50290/78, 160387/76, 65597/78, 82666/78, 104652/78, 104691/78, 105589/78 (the term "OPI" as used herein refers to a "published unexamined Japanese Patent Application"), Japanese Patent Publication Nos. 13495/78, 13678/78, etc. hydrolyzates of acrylonitrile type polymers as described in Japanese Patent Application (OPI) Nos. 80493/78, 60985/78, 63486/78, etc., and the like.

In the above description, examples of the vinyl ester include vinyl acetate, vinyl propionate, vinyl stearate, etc. (preferably vinyl acetate).

Examples of the ethylenically unsaturated carboxylic acid or derivative thereof include acrylic acid, methacrylic acid, crotonic acid, itaconic acid, maleic acid, fumaric acid, maleic acid anhydride, itaconic acid anhydride, esters of these compounds, acrylamide, and methacrylamide,with acrylic acid, methacrylic acid, methyl, ethyl, n-propyl, isopropyl, n-butyl, and t-butyl esters, acrylamide, methacrylamide, etc., being preferable.

The molar ratio of vinyl ester component (x) to ethylenically unsaturated carboxylic acid component (y), x/y, is from 20/80 to 80/20, preferably from 30/70 to 70/30, and particularly preferably from 40/60 to 60/40.

Other ethylenic components may be incorporated in the copolymer in a range of from 1 to 10 mol %, and preferably from 3 to 7 mol %.

Examples of the ethylenic components include ethylene, propylene, 1-butene, isobutene, styrene, etc.

The saponification degree is preferably 30 mol % or more of the vinyl ester component in the above-described copolymers, or, when ethylenically unsaturated carboxylic acid ester is copolymerized, 30 mol % of more (particularly preferably 70 mol % or more) of the ester.

Specific examples include a saponification product of a vinyl acetate-methyl acrylate copolymer containing 62 mol % methyl acrylate (90 mol % in saponification degree), a saponification product of a vinyl acetate-methyl acrylate copolymer containing 20 mol % of methyl acrylate (98 mol % in saponification degree), a saponification product of a vinyl acetate-methyl acrylate copolymer containing 48 mol % of methyl acrylate (98.3 mol % in saponification degree), etc., and, as a commercially available product, there are Sumika Gel (registered trademark) L-5 (H) made by Sumitomo Chemical Co., Ltd., etc.

Hydrolyzates of acrylonitrile type polymers are described in more detail below.

The expression "acrylonitrile type polymer" is a general expression for polymers containing acrylonitrile as a comonomer. Specifically, there are illustrated acrylonitrile homopolymers, copolymers of acrylonitrile and other one, two or more ethylenically unsaturated compound, and graft polymers of acrylonitrile and other polymers such as starch or polyvinyl alcohol.

In the above description, examples of the ethylenically unsaturated compounds include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1 vinyl-2-methylimidazole, monoethylenically unsaturated esters of aliphatic acids (e.g., vinyl acetate and allyl acetate), ethylenically unsaturated mono- or dicarboxylic acids, and salts thereof (e.g., acrylic acid, methyacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unmsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine), etc.

The content of skeletal acrylonitrile is desirably 30 wt % or more, and more preferably 50 wt % or more.

Hydrolyzates of the acrylonitrile type polymer are polymers containing acrylic salt and acrylamide formed by hydrolysis of acrylonitrile moiety.

Specific examples include a hydrolyzate of an acrylonitrile-methylacrylate copolymer containing 90 mol % of acrylonitrile, a hydrolyzate of a starch-acrylonitrile graft polymer, a hydrolyzate of a copolymer containing 85 mol % of acrylonitrile, 6.2 mol % of methyl acrylate, and 8.8 mol % of vinylidene chloride, etc.

Copolymers composed of ethylenically unsaturated carboxylic acid and vinyl monomer having a group capable of crosslinking agent after coating may be used as the highly water-absorbing high molecular weight compound. Examples of the vinyl monomer having a group capable of crosslinking by a crosslinking agent after coating include a vinyl sulfone group-containing vinyl monomer, a sulfinic acid group-containing vinyl monomer, a hydroxy group-containing vinyl monomer, an amino group-containing vinyl monomer, etc. Specific examples of the vinyl monomer are shown in U.S. Pat. No. 4,552, 835 as monomer unit(b).

The highly water-absorbing high molecular weight compound of the present invention may be used alone to form a coating film, or may be used in combination with other hydrophilic colloid such as gelatin to form a coating film.

In the case of using the highly water-absorbing high molecular weightcompound of the present invention alone to form a coating film, it is desirable to use a crosslinking agent or, in place of or in combination with the use of crosslinking agent, to conduct curing after coating. Examples of crosslinking agent suitable for such use include aldehydes such as glutaraldehyde, glyoxal, adipaldehyde, etc., epoxy compounds such as epichlorohydrin, ethylene glycol glycidyl ether, polyethylene glycol glycidyl ether, glycerin diglycidyl ether, trimethylolpropane triglycidyl ether, 1,6-hexanediol diglycidyl ether, etc., bishalogen compounds such as dichlorohydrin, dibromohydrin, etc., and isocyanate compounds such as 2,4-tolylenediisocyanate, hexamethylenediisocyanate, etc., N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydroxy-s-triazine, bis(vinylsulfonyl)methyl ether, and N,N'-ethylene-bis(vinylsulfonylacetamide)), active halogen compounds (e.g., 2,4-dichloro-6-hydroxy-s-triazine), mucohalogenic acids (e.g., mucochloric acid and mucophenoxychloric acid), isooxazoles, dialdehydestarch, and 1-chloro-6-hydroxytriazinylated gelatin, with epoxy compounds being preferable. These crosslinking agents are used usually in amounts of from 0.005 to 20 wt %, particularly from 0.01 to 2 wt %, basd on the weight of the highly water-absorbing high molecular weight compound. Curing concitions are not particularly limited but, usually, curing is sufficiently conducted at from 40° C. to 180° C. for from 30 seconds to 2 hours, preferably at from 50° C. to 120° C. for from 30 seconds to 30 minutes. Of course, the higher the curing temperature, the shorter the curing time.

Additionally, in the case of using the highly water-absorbing high molecular weight compound in combination with other crosslinkable hydrophilic colloid such as gelatin, addition of the crosslinking agent and curing for the highly water-absorbing high molecular weight compound may not be conducted.

In the present invention, the highly water-soluble high molecular weight compound is preferably used in an amount of from 0.1 to 20 g, and particularly preferably from 0.5 to 5 g, per $m^2$ of the support.

The highly water-absorbing high molecular weight compound of the present invention can be used in light-sensitive materials and/or dye-fixing materials to be used for a color image-forming process wherein diffusible dyes are imagewise formed or released, followed by fixing the dyes.

The above-described color image-forming process includes various embodiments such as a color diffusion transfer process of using a developer to conduct development (described, for example, in Belgian Patent 757,959), a heat-development process of conducting heat-development in a substantially water-free state (described, for example, in European Patent 76,492A2, U.S. Pat. Nos. 4,483,914, 4,500,626, etc.), and the like. The highly water-absorbing high molecular weight compounds of the present invention may be used in any of said processes. That is, when used in the light-sensitive materials and/or dye-fixing materials (hereinafter in some cases referred to as image-receiving materials) of color diffusion transfer process of using a developer, the high molecular weight compounds can shorten the time of development processing and/or dye transfer, and reduce temperature dependence of developing time. On the other hand, when used in the light-sensitive materials and/or dye-fixing materials of heat development process of forming diffusible hydrophilic dye image by the heat-development, the highly water-absorbing high molecular weight compound can shorten the time necessary for transferring the aforesaid hydrophilic dye from the light-sensitive material to the dye-fixing material by using a small amount of water, and can form an image with high transfer density and no transfer unevenness.

The highly water-absorbing high molecular weight compound of the present invention may be used in various layers of the above-described light-sensitive materials and/or dye-fixing materials, such as a light-sensitive layer, an interlayer, a layer containing dye-providing substance, an image-receiving layer, a white reflection layer, a neutralization layer, a neutralizationl timing layer, etc., or may be used in a specially provided water-absorbing layer. Particularly remarkable effects are obtained by usingthe compound in a mordant layer of the dye-fixing material or an auxiliary layer provided on the same side as the mordant layer side with respect to the support, such as a subbing layer, a protective layer, a water-absorbing layer, or the like, of the dye-fixing material.

Dye-providing substances useful for the above-described color image-forming process are represented by formula (I), and are used in combination with a silver halide emulsion;

$$Dy—Y \qquad (I)$$

wherein Dy represents a dye moiety (or its precursor moiety), and Y represents a substrate having such function that it causes change in diffusibility of the dye-providing substance (I) as a result of development.

The expression "change in diffusibility" as used herein means that (I) an initially non-diffusible dye-providing substance (I) is changed into diffusible one or releases a diffusible dye, or that (2) an initially diffusible dye-providing substance (I) is changed into non-diffusible one.

This change is caused by oxidation or reduction of Y, depending upon the properties of Y.

Examples of substances which undergo "change in diffusibility" as a result of oxidation of Y, include so-called dye-releasing redox substrates such as p-sulfonamidonaphthols (including p-sulfonamidophenols, specific examples being described in U.S. Pat. Nos. 3,928,312, 3,993,638, 4,076,529, and 4,152,153, Japanese Patent Application (OPI) No. 50736/78, European Patent 76,492), o-sulfonamidophenols (including o-sulfonamidonaphthols, specific examples being described in Japanese Patent Application (OPI) Nos. 12642/81, 16130/81, 4043/82, 650/82, U.S. Pat. Nos. 4,053,312, 4,055,428, 4,336,322 and European Patent 76,492), hydroxysulfonamide heterocyclic compounds (specific examples being described in U.S. Pat. No. 4,198,235 and European Patent 76,492), 3-sulfonamidoindoles (specific examples being described in U.S. Pat. Nos. 4,198,235, 4,179,291, 4,273,855, 4,499,181, and European Patent 76,492), α-sulfonamidoketones (specific examples being described in U.S. Pat. No. 4,148,892, Japanese Patent Application (OPI) No. 48534/79, and European Patent 76,492), etc.

Another type example includes intramolecular assist type substrates described in Japanese Patent Application (OPI) No. 65839/84 and U.S. Pat. No. 4,358,532, which release a dye upon intramolecular nucleophilic attack.

Further type examples include those substrates which, under basic conditions, release a dye as a result of intramolecular ring-closing reaction but which, when Y is oxidized, no longer substantially release a dye (U.S. Pat. Nos. 3,980,479 and 4,108,850 describing specific examples). Further, as a modified type thereof, those substrates which cause winding change of an isoxazolone ring when attacked by a nucleophilic reagent are useful (U.S. Pat. Nos. 4,199,354, 4,278,598, and 4,199,355 describing specific examples thereof).

Still further type examples include those substrates which, under basic conditions, release a dye moiety as a result of dissociation of acidic proton, but which, when Y is oxidized, no longer substantially release the dye. Japanese Patent Application (OPI) No. 69033/78 and U.S. Pat. No. 4,232,107 describe specific examples.

On the other hand, examples which undergo change in diffusibility upon reduction of Y include nitro compounds described in U.S. Pat. No. 4,139,379, and quinone compounds described in U.S. Pat. Nos. 4,139,379, 4,356,249 and 4,358,525. These release a dye upon intramolecular attack by a nucleophilic group formed as a result of reduction with a reducing agent not having been consumed in the developing step (called electron donor). As a modified type thereof, quinone type substrates are also useful from which a dye moiety is eliminated by dissociation of an acidic proton from the reduced substrate. Specific examples thereof are described in U.S. Pat. Nos. 4,232,107 and 4,371,604.

In the case of using the above-described substrates which undergo change in diffusibility as a result of reduction, a proper reducing agent (electron donor) is necessary which intermediates between exposed silver halide and a dye-providing substance. Specific examples thereof are described in the above-mentioned known documents. In addition, those substrates which contain an electron donor in substrate Y (called LDA (Linked Doner Acceptor) compounds) are also useful.

As still further type dye-providing substances, there may be used those which have a dye moiety and which undergo change in mobility as a result of oxidation-reduction reaction with silver halide or an organic silver salt at elevated temperatures. Examples thereof are described in Japanese Patent Application (OPI) No. 165054/84.

In addition, Japanese Patent Application (OPI) No. 180548/84 describes those dye-providing substances which release a mobile dye as a result of reaction with silver ion contained in a light-sensitive material.

The above-described dye-providing substances from an imagewise distribution of mobile dye in conformity with exposure in a light-sensitive element upon development processing, and processes for transferring these image dyes to a dye-fixing element (so-called diffusion transfer) to visualize are described in the above-described patents or Japanese Patent Application (OPI) Nos. 168439/84, 182447/84, etc.

Photographic elements containing the highly water-adsorbing high molecular weight compound of the present invention adapted for the above-described color image-forming processes may be those light-sensitive materials which comprise a support having provided thereon at least one silver halide emulsion layer or dye-fixing materials having no light sensitivity, or may be film units wherein such light-sensitive material (light-sensitive element) is combined with the dye-fixing material (image-receiving element).

A typical embodiment of a film unit is that in which the above-described image-receiving element and the light-sensitive element are provided on one transparent support, and which does not require peeling the ligh-sensitive element apart from the image-receiving element after completion image transfer. More specifically, the image-receiving element comprises at least one mordant layer, and the light-sensitive element is constituted, in a preferable embodiment, by a combination of a blue-sensitive emulsion layer, a green-sensitive emulsion layer, and a red-sensitive emulsion layer, a combination of a green-sensitive emulsion layer, a red-sensitive emulsion layer, and an infrared light-sensitive emulsion layer, or a combination of a blue-sensitive emulsion layer, a red-sensitive emulsion layer, and an infrared light-sensitive emulsion layer, with each emulsion layer being associated with a yellow dye-providing substance, a magenta dye-providing substance, or a cyan dye-providing substance. The term "infrared light-sensitive emulsion layer" as used herein means an emulsion layer having sensitivity to light of 700 nm or longer, particularly 740 nm or longer, in wavelength. In order to view the transferred image through the transparent support, a white reflection layer containing a solid pigment such as tatanium white is provided between the mordant layer and the light-sensitive layer or the layer containing dye-providing substance. A light screening layer may be further provided between the white reflection layer and the light-sensitive layer so as to enable complete development processing in a bright room. If desired, a peeling layer may be provided so as to enable wholly or partly peeling the light-sensitive element from the image-receiving element. Such an embodiment is described, for example, in Japanese Patent Application (OPI) No. 67840/81 and Canadian Patent 674,082.

In another peeling-free embodiment, the aforementioned light-sensitive element is coated on one transparent support, a white reflection layer is coated thereon and, further, an image-receiving layer is provided thereon U.S. Pat. No. 3,730,718 describes an embodiment in which an image-receiving element, a white reflection layer, a peeling layer, and a light-sensitive element are provided on one and the same support, with the light-sensitive element being intently peeled apart from the image-receiving element.

On the other hand, typical embodiments in which the light-sensitive element and the image-receiving element are separately provided on two supports are divided roughly into two classes: one being a peel-apart type; the other being a peel-free type. To describe them in detail, in a preferable peel-apart type film unit a light-reflecting layer is provided on the back side of a support, with at least one image-receiving layer being coated on the light-reflecting layer. A light-sensitive element is coated on a support having a light screening layer. Before completion of exposure, the light-sensitive layer-coated surface and the mordant layer-coated surface do not face each other but, after completion of the exposure (for example, during development processing), the light-sensitive layer-coated surface is designed to be turned over onto the image-receiving layer-coated surface. After formation of a transferred image in the mordant layer, the light-sensitive element is rapidly peeled apart from the image-receiving element.

In a preferable embodiment of peeling-free type film units, at least one mordant layer is coated on a transparent support, whereas a light-sensitive element is coated on a support which is transparent or has a light screening layer, with the light-sensitive layer-coated surface facing the mordant layer-coated surface.

Any of the above-described embodiments may be applied to both color diffusion transfer process and heat-development process. Particularly in the former process, the embodiment may further be combined with a pressure-repturable container (processing element) retaining an alkaline processing colution. Above all, with peeling-free type film units wherein the image-receiving element and the light-sensitive element are provided in layer on one support, this processing element is preferable disposed between the light-sensitive element and a cover sheet to be superposed thereon. With the embodiment wherein the light-sensitive element and the image-receiving element are separately provided on two supports, it is preferable to dispose the processing element between the light-sensitive element and the image-receiving element at the latest upon development processing. The processing element preferably contains a light screening agent (e.g., carbon black, a dye having a pH-dependent color, etc.) and/or a white pigment (e.g., titanium white) according to the type of film unit. Further, with color diffusion transfer process film units, a neutralization-timing mechanism comprising a combination of a neutralizing layer and a neutralization-timing layer is preferably provided in a cover sheet, image-receiving element or light-sensitive element.

On the other hand, with heat-development process film units, a heating layer containing conductive particles such as metallic fine powder, carbon black, graphite, etc., may be provided in a proper position of a support, light-sensitive element or image-receiving element to utilize Joule heat generated by energization for heat-development or diffusion transfer of dyes. The conductive particles may be replaced by semiconductive inorganic materials (e.g., silicon carbide, molybdenum silicide, lanthanum chloride, barium titanate ceramics, tin oxide, zinc oxide, etc.).

In the case of a heat-development process, the amount of water to be supplied to the dye-fixing material upon transfer of diffusible dyes is not more than is necessary for swelling to maximum the coating film of the dye-fixing material (in other words, not more than the amount calculated by subtracting the weight of the coating film from the amount of water corresponding to the volume of the coating film upon maximum swelling). Measurement of swelling was conducted according to the method described in *Photographic Science Engineering*, Vol. 16, p. 449 (1972).

If water is used in an amount more than the above-described region, there results blurring of transferred image, thus being inconvenient.

On the other hand, the minimum amount of water for image transfer is an amount sufficient to transfer the dyes, and, preferably, water in an amount 0.1 times the total weight of the coating films of the diffusible dye-containing material and the dye-fixing material serves to completely transfer released dyes. Water of the same volume as, or more than, that of dry film thickness of the diffusible dye-containing material can provide preferable results with respect to transfer speed.

The amount of water to be supplied in the above description means the amount of water to be supplied into the dye-fixing material at the time when the diffusible dye-containing material is brought into contact with the dye-fixing material. Therefore, water in the amount of the above-described range may previously be measured to supply to the dye-fixing material, or water may be supplied in an excess amount followed by pressure-squeezing by a roller, etc, or heat-drying so that the amount of water falls within the above-described range.

As methods for supplying water to the dye-fixing material, a roller-coating method or a wire bar-coating method as described in Japanese Patent Application (OPI) No. 55907/83, a method of supplying water to the dye-fixing material using a water-absorbing member as described in Japanese Patent Application (OPI) No. 181354/84, a method of supplying water by forming beads between a water-repelling roller and the dye-fixing material as described in Japanese Patent Application (OPI) No. 181348/84, a dip-coating method, an extrusion coating method, a method of supplying water by jetting water through fine pores, a method of supplying water by pressure-rupturing a pod, etc. may be employed. Additionally, in the above description, where water is not absorbed, after being supplied, by a coating layer of the dye-fixing material exists on the surface of the material, it is preferably removed by applying pressure using rollers or the like to thereby squeeze away, blowing, or by applying hot air to dry so as to obtain transferred images of good quality with no blurring.

Water as used herein means not only "pure water", but generally any commonly available water. Thus, water to be used in the present invention includes ordinary drinking water, industrial water, etc. For the ordinary drinking water, there are the standard on water quality provided by U.S.A. for civil water, and that provided by WHO (World Health Organization). Water satisfying these standards may be used in the present invention. Water commonly used for various industries are also included in water mentioned in the present invention. Standards on quality of water to be used in various industries are described, for example, in *Eisei-Kogaku Handbook*, published by Asakura Shoten in 1967, p. 356. Any of underground water, river water, and water to which chemicals (e.g., sodium hydroxide, potassium hydroxide, etc.) are intently added may be used as water mentioned in the present invention as long as they satisfy the standards described above.

In the heat development process, the coating side of the thus water-supplied dye-fixing material on which side the dye-fixing layer exists is superposed on the coating side of the material wherein diffusible dyes are imagewise produced or released by heat development or the like on which side the diffusible dye-containing layer exists, and the assembly is heated to thereby transfer the diffusible dyes from the latter to the former dye-fixing material.

As heating means in the transfer step, a heating technique of passing between hot plates or bringing into contact with a hot plate (for example, Japanese Patent Application (OPI) No. 62635/75), a heating technique of bringing into contact with a rotating hot drum or hot roller (for example, U.S. Pat. No. 3,371,915), a heating technique of passing through a hot atmosphere (for example, Japanese Patent Application (OPI) No. 32737/78), a heating technique of passing through an inert liquid kept at a definite temperature, a heating technique of conveying along a heat source using rollers, belt, or guide member (Japanese Patent Publication No. 2546/69), etc., may be employed. Alternatively, a layer of a conductive material such as graphite, carbon black, metal, or the like may be superposedly provided on the dye-fixing material, which layer is energized to directly heat the material.

With heat-developable light-sensitive materials, the heat temperature to be applied thereto in the aforesaid transfer step may be a temperature of from the heat-developing step to room temperature, with 60° C. to the temperature lower than the temperature employed in the heat-developing step by 10° C. or more being particularly preferable.

The pressure to be applied to the assembly of the diffusible dye-containing material and the dye-fixing material to closely contact them to each other varies depending upon the embodiment and materials used, but a pressure of from 0.1 to 100 kg/cm$^2$, preferably from 1 to 50 kg/cm$^2$, being suitable (described, for example, in Japanese Patent Application (OPI) No. 180547/84).

As the means for applying pressure to the assembly, various methods such as a method of passing through paired rollers, a method of pressing using a plate with a good smoothness, etc. may be employed. Rollers and plates to be used for applying pressure may be heated from room temperature to the temperature employed in the heat-developing step.

In the present invention, dye transfer assistants other than water may be used. As such assistants other than water, alkaline aqueous solutions containing sodium hydroxide, potassium hydroxide, an inorganic alkaline metal salt, etc., and low-boiling solvents such as methanol, N,N-dimethylformamide, acetone, diisobutyl ketone, etc. are used with respect to the system of supplying the dye transfer assistants from outside. The dye transfer assistants may also be used by wetting the dye-fixing material with them.

Incorporation of the assistant in the light-sensitive material or the dye-fixing material eliminates the necessity of supplying the assistant from outside. A preferably system comprises incorporating a hydrophilic thermal solvent which is solid at an ordinary temperature but which becomes liquid at elevated temperatures in the diffusible dye-containing material or the dye-fixing material. The hydrophilic thermal solvent may be incorporated in either of the diffusible dye-containing material or the dye-fixing material, or both of them. Layers in which the solvent is to be incorporated may be any of emulsion layers, interlayers, protective layers, and dye-fixing layers, with dye-fixing layers and/or the adjacent layers thereof being preferable.

Examples of the hydrophilic thermal solvents include ureas, pyridines, amides, sulfonamides, imides, alcohols, oximes, and other hetero ring compounds.

As the mordant to be used in the dye-fixing material of the above-described color image-forming process, any of those which are ordinarily used may be selected, with polymer mordants being particularly preferable. The polymer mordants include polymers having tertiary amino groups, polymers having nitrogen-containing heterocyclic moieties, polymers having quaternary cation groups thereof, etc.

Polymers containing tertiary amino group-containing vinyl monomer units are described in Japanese Patent Application (OPI) Nos. 57836/85, 60643/85, etc., and specific examples of polymers having tertiary imidazole group-containing vinyl monomer units are described in Japanese Patent Application (OPI) Nos. 118834/85 (corresponding to U.S. Pat. No. 4,594,308) and 122941/85(Corresponding to U.S. Pat. No. 4,619,883), U.S. Pat. Nos. 4,282,305, 4,115,124, 3,148,061, etc.

Preferable specific examples of polymers having quaternary imidazolium salt-containing vinyl monomer units are described in British Patents 2,056,101, 2,093,041, and 1,594,961, U.S. Pat. Nos. 4,124,386, 4,115,124, 4,273,853, 4,450,224, Japanese Patent Application (OPI) No. 28,225/73.

Other preferable specific examples of polymers having quaternary ammonium salt-containing vinyl monomer units are described in U.S. Pat. Nos. 3,709,690, 3,898,088, 3,958,995, Japanese Patent Application (OPI) Nos. 57836/85, 60643/85, 122940/85, 122942/85, 235134/85, etc.

Combined use of the polymer mordant and metal ion serves to enhance the density of the transferred image.

This metal ion is added to the mordant-containing, dye-fixing layer or an upper or lower layer adjacent to the dye-fixing layer. The metal ion to be used here is colorless and desirably stable against heat and light. That is, polyvalent ions of transition metals such as $Cu^{2+}$, $Zn^{2+}$, $Ni^{2+}$, $Pt^{2+}$, $Pd^{2+}$, $Co^{2+}$, etc., are preferable, with $Zn^{2+}$ being particularly preferable.

With a heat-developing process, a reducing agent is preferably incorporated in the light-sensitive material. Such reducing agents include the aforementioned dye-providing substances having reducibility as well as those generally known as reducing agents. In addition, precursors of reducing agents which does not possess reducibility, but, when attacked with a nucleophilic reagent or heated in the developing step, develop reducibility are also included.

Examples of the reducing agents to be used in the present invention include inorganic reducing agents (e.g., sodium sulfite, sodium hydrogen sulfite, etc.), benzenesulfinic acids, hydroxylamines, hydrazines, hydrazides, borane.amine complex, hydroquinones, aminophenols, catechols, p-phenylenediamines, 3-pyrazolidinones, hydroxytetronic acid, ascorbic acid, 4-amino-5-pyrazolones, etc. Those reducing agents which are described in T. H. James, *The Theory of the Photographic Process*, 4th, Ed., pp. 291-334 are also usable. The precursors of reducing agents described in Japanese Patent Application (OPI) Nos. 138736/81 and 40245/82, U.S. Pat. No. 4,330,617, etc. are also utilizable.

Combinations of various developing agents as disclosed in U.S. Pat. No. 3,039,869 may be used as well.

With the heat-developing process, organic metal salts comparatively stable against light may be used together with light-sensitive silver halide. In such case, light-sensitive silver halide and the organic metal salt must be in contact with each other or within a near distance from each other. Of such organic metal salts, organic silver salts are particularly preferable. In using the organic metal salt together with silver halide, the organic metal salt is considered to participate in the redox reaction with the catalytic aid of silver halide latent image when the heat-developable light-sensitive material is heated to 80° C. or above, and preferably 100° C. or above.

As the organic compounds to be used for forming the above-described organic silver salt oxidizing agents, there are illustrated aliphatic or aromatic carboxylic acids, compounds having mercapto group or α-hydrogen-containing thiocarbonyl group, imino group-containing compounds, etc.

Typical examples of the silver salts of aliphatic carboxylic acid include silver salts derived from behenic acid, stearic acid, oleic acid, lauric acid, capric acid, myristic acid, palmitic acid, maleic acid, fumaric acid, tartaric acid, furoinic acid, linoleic acid, linolenic acid, oleic acid, adipic acid, sebacic acid, succinic acid, acetic acid, butyric acid, or camphoric acid. Silver salts derived from halogen atom or hydroxy group-substituted derivatives of these aliphatic acids or thioether group-containing aliphatic carboxylic acids are also usable.

Typical examples of the silver salts or aromatic carboxylic acid and other carboxyl group-containing compounds include silver salts derived from benzoic acid, 3,5-dihydroxybenzoic acid, o-, m-, or p-methylbenzoic acid, 2,4-dichlorobenzoic acid, acetamidobenzoic acid, p-phenylbenzoic acid, gallic acid, tannic acid, phthalic acid, terephthalic acid, salicyclic acid, phenylacetic acid, pyromellitic acid, 3-carboxymethyl-4-methyl-4-thiazoline-2-thione, etc. As the silver salts of mercapto or thiocarbonyl group-containing compounds, there are illustrated silver salts derived from 3-mercapto-4-phenyl-1,2,4-thiazole, 2-mercaptobenzimidazole, 2-mercapto-5-aminothiadiazole, 2-mercaptobenzothiazole, s-alkylthioglycollic acid (containing from 12 to 22 carbon atoms in the alkyl moiety), dithiocarboxylic acids (e.g., dithioacetic acid), thioamides (e.g., thiostearoamide), 5-carboxy-1-methyl-2-phenyl-4-thiopyridine, mercapto compounds (e.g., mercaptotriazine, 2-mercaptobenzoxazole, mercaptooxadiazole, 3-amino-5-benzylthio-1,2,4-triazole, etc. described in U.S. Pat. No. 4,123,274), etc.

Typical examples of silver salts of imino group-containing compounds include silver salts derived from benzotriazole or derivatives thereof described in U.S. Pat. Nos. 3,699,114 and 3,635,719, alkyl-substituted benzotriazoles such as benzotriazole and methylbenzotriazole, halogen-substituted benzotriazoles such as 5

-chlorobenzotriazole, carboimidobenzotriazoles such as butylcarboimidobenzotriazole, nitrobenzotrriazoles described in Japanese Patent Application (OPI) No. 118639/83, sulfobenzotriazole, carboxybenzotriazole or salts thereof or hydroxynenzotriazole described in Japanese Patent Application (OPI) No. 118638/83, 1,2,4-triazole, 1H-tetrazole, carbazole, saccharin, imidazole and derivatives thereof described in U.S. Pat. No. 4,220,709, and the like.

In addition, silver salts described in *Research Disclosure*, RD No. 17029 (June, 1987), organic metals other than silver salts such as copper stearate, and silver salts of alkyl group-containing carboxylic acids such as phenylpropiolic acid described in Japanese Patent Application (OPI) No. 113235/85 are also usable in the present invention.

In the case of a heat-developing process, various other additives known for heat-developable light-sensitive materials may be added. Such additives are described, for example, in Japanese Patent Application (OPI) Nos. 48764/84, 57231/84, 74547/84, 111636/84, U.S. Pat. Nos. 4,500,626, 4,483,914, 4,473,631, etc.

The highly water-absorbing high molecular weight compounds of the present invention may also be used for various conventional silver halide photographic light-sensitive materials.

The compounds of the present invention may be used in color photographic light-sensitive materials of, for example, coupler process for the purpose of accelerating development or desilvering. As the color light-sensitive materials, there are illustrated color negative films for photographing (for amateur, professional, or cinema use, etc.), color reversal films, photographic color printing papers, photographic color reversal printing papers, cinema positive films, etc.

The compounds of the present invention may also be applicable to the silver dye-bleach process as described, for example, in *The Theory of the Photographic Process*, Chapter 12, "Principles and Chemistry of Color Photography IV., Silver Dye Bleach Process", 4th ed., T. H. James ed., Macmillan, New York, 1977, pp. 363–366.

The compounds of the present invention may further be used in black-and-white light-sensitive materials for the purpose of accelerating development and obtaining desired maximum image density with short-time processing. Examples of black-and-white light-sensitive materials include X-ray films for medical use, black-and-white films for amateur use, lith films, scanner films, etc.

The compounds of the present invention are preferably used in emulsion layers, interlayers, or surface-protecting layers of color and black-and-white light-sensitive materials. In the case of using them in color light-sensitive materials, sharpness is improved by using them in an interlayer (since coating film thickness of the interlayer can be reduced) and, in addition, color mixing is prevented because they greatly swell upon processing.

Silver halide to be used in the present invention may be any of silver chloride, silver bromide, silver iodide, silver chlorobromide, silver chloroiodide, silver iodobromide, and silver chloroiodobromide. Halogen composition within the grains may be uniform or different between the surface and the inner portion to form a multi-layered structure (Japanese Patent Application (OPI) Nos. 108533/83, and 52237/84, U.S. Pat. Nos. 4,433,048, 4,444,877, and 4,507,386 and European Patent 100,984). Tabuler grains having a thickness of 0.5 μm or less, a diameter of at least 0.6 μm, and an average aspect ratio of 5 or more (U.S. Pat. Nos. 4,414,310 and 4,435,499, West German Patent Application (OLS) No. 3,241,646A1, etc.) or monodisperse emulsions having an almost uniform grain size distribution (Japanese Patent Application (OPI) Nos. 14829/83, U.S. Pat. Nos. 4,446,228, 4,446,226 and 4,511,648, International Publication 83/02338A1, European Patents 4,412A3 and 83,377A1, etc.) are also usable in the present invention. Two or more silver halides different from each other in crystal habit, silver halide composition, grain size, grain size distribution, etc. may be used. Two or more monodisperse emulsions different in grain size may be mixed to adjust gradation.

Silver halide grains to be used in the present invention preferably have an average grain size of from 0.001 μm to 10 μm, more preferably from 0.001 μm to 5 μm. These silver halide emulsions may be prepared by any of an acidic method, a neutral method or an ammonia method. As a manner of reacting a soluble silver salt with a soluble halide salt, any of a single jet method, or a double jet method, or a combination thereof may be employed. A reverse mixing method of forming grains in the presence of excess silver ion, or a controlled double jet method wherein pAg is kept constant may be employed. Further, for the purpose of accelerating grain growth, the concentrations, adding amounts or adding rates of silver salts and halides may be raised (Japanese Patent Application (OPI) No. 158124/80, U.S. Pat. Nos. 3,650,757, and 4,301,241 etc.).

Epitaxial over grown type silver halide grains are also usable (U.S. Pat. Nos. 4,094,684 and 4,349,622).

In the case of independently using silver halide without the organic silver salt oxidizing agent according to the heat-developing process, it is preferable to use silver chloroiodide, silver iodobromide or silver chloroiodobromide having an X-ray pattern showing existence of silver iodide crystals.

Silver iodobromide having the above-described characteristics may be obtained, for example, by adding a silver nitrate solution to a potassium bromide solution to form silver bromide grains, then adding potassium iodide thereto.

In the step of forming silver halide grains to be used in the present invention, ammonia, organic thioether derivatives described in U.S. Pat. No. 3,574,628 or sulfur-containing compounds described in Japanese Patent Application (OPI) No. 144319/78 may be used as silver halide solvents.

In the step of grain formation or physical ripening, cadmium salts, zinc salts, lead salts, thallium salts, etc. may be present.

Further, water-soluble iridium salts such as iridium (III,IV) chloride, ammonium hexachloroiridate, etc. or water-soluble rhodium salts such as rhodium chloride may be used for the purpose of improving any high intensity reciprocity failure or low intensity reciprocity failure.

Soluble salts may be removed from the silver halide emulsion after formation of precipitate or after physical ripening. This removal may be conducted according to the noodle-washing process or flocculation process.

The silver halide emulsion may be used without post-ripening, but are usually chemically sensitized. Sulfur sensitization process, reduction sensitization process, noble metal sensitization, etc. known with emulsions for ordinary light-sensitive materials may be employed alone or in combination. These chemical sensitization may be conducted in the presence of nitrogen-containing heterocyclic compounds (Japanese Patent Application (OPI) Nos. 126526/83 and 215644/83).

The silver halide emulsions to be used in the present invention may be of the surface latent image type forming latent image mainly on the grain surface or of the internal latent image type forming latent image within them. Direct reversal emulsions wherein the internal latent image type emulsion is combined with a nucleating agent may be used as well. Internal latent image type emulsions adapted for this purpose are described in U.S. Pat. Nos. 2,592,250, 3,761,276, 4,431,730 Japanese Patent Publication No. 3534/83, etc. Nucleating agents preferably combined in the present invention are described in U.S. Pat. Nos. 3,227,552, 4,245,037, 4,255,511, 4,266,031, 4,276,364, and West German Patent Application (OLS) No. 2,635,316, etc.

Silver halide to be used in the present invention may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those which belong to cyanine dyes, merocyanine dyes, and complex mercyanine dyes. In these dyes, any of nuclei ordinarily used as basic hetero ring nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic hydrocarbon ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be used. These nuclei may be substituted in the carbon atoms.

In the merocyanine dyes or complex merocyanine dyes, 5- or 6-membered hetero ring nuclei such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc. may be used as ketomethylene structure-containing nuclei.

These sensitizing dyes may be used alone or in combination. Combinations of sensitizing dyes are often employed, particularly for the purpose of supersensitization.

A dye which itself does not have a spectrally sensitizing effect or a substance which substantially does not absorb visible light and which shows a supersensitizing effect may be incorporated together with the sensitizing dye. For example, aminostilbene compounds substituted by a nitrogen-containing hetero ring group (for example, those described in U.S. Pat. Nos. 2,933,390 and 3,635,721), aromatic organic acid-formaldehyde condensates (for example, those described in U.S. Pat. No. 3,743,510), cadmium salts, azaindene compounds, etc. may be incorporated. Combinations described in U.S. Pat. Nos. 3,615,613, 3,615,641, 3,617,295, and 3,635,721 are particularly useful.

As a binder or protective colloid to be used in the emulsion layers or interlayers of the light-sensitive material of the present invention, gelatin is advantageously used. However, other hydrophilic colloids can be used along or together with gelatin.

Gelatin to be used in the present invention may be lime-processed or acid-processed gelatin. Processes for preparing gelatin are described in detail in Arthur Veis, *The Macromolecular Chemistry of Gelatin* (Academic Press, 1964).

Surfactants may be added, alone or in combination, to the photographic emulsion of the present invention.

They are used as coating aids but, in some cases, for other purposes such as improvement of emulsion dispersion, improvement of photographic sensitization properties, antistatic purpose, prevention of adhesion, etc. The surfactants are grouped into: natural surfactants such as saponin; nonionic surfactants such as alkylene oxide derivatives, glycerin derivatives, glycidol derivatives, etc.; cationic surfactants such as higher alkylamines, quaternary ammonium salts, heterocyclic compounds (e.g., pyridine, etc.), phosphonium compounds, sulfonium compounds, etc.; anionic surfactants having an acidic group such as a carboxylic acid group, a sulfonic acid group, a phosphoric acid group, a sulfuric acid ester group or a phosphoric ester group; and amphoteric surfactants such as amino acids aminosulfonic acids, aminoalcohol sulfuric or phosphoric esters, etc.

Various compounds may be incorporated in the photographic emulsion to be used in the present invention for the purpose of preventing formation of fog or stabilizing photographic properties in the steps of producing, or during storage or processing of, light-sensitive materials. That is, azoles (e.g., benzothiazolium salts, nitroimidazoles, nitrobenzimidazoles, chlorobenzimidazoles, brombenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindenes (e.g., triazaindenes, tetrazaindenes (particularly 4-hydroxy-substituted (1,3,3*a*,7) tetrazaindenes), pentazaindenes, etc.); benzenethiosulfonic acid, benzenesulfinic acid, benzenesulfonic acid amide, etc., known as antifoggants or stabilizers can be added.

The photographic light-sensitive material of the present invention may contain in its photographic emuslsion layers thioether compounds, thiomorpholine compounds, quaternary ammonium salt compounds, urethane derivatives, urea derivatives, imidazole derivatives, 3-pyrazolidones, etc. for the purpose of increasing sensitivity or contrast, or accelerating development.

The photographic light-sensitive material to be used in the present invention may contain in the photographic emulsion layer or other hydrophilic colloidal layers a water-insoluble or sparingly water-soluble synthetic polymer dispersion for the purpose of improving dimensional stability or the like. For example, polymers containing as monomer components alkyl (meth)acrylates, alkoxyalkyl (meth)acrylates, glycidyl (meth)acrylate, (meth)acrylamide, vinyl esters (e.g., vinyl acetate), acrylonitrile, olefin, styrene, etc. alone or in combination, or polymers containing as monomer components combinations of the above-described monomers and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc. may be used.

In applying the present invention to coupler process color photographic light-sensitive materials, any of conventionally known couplers may be used. For example, magenta couplers to be used include 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetylcoumarone couplers, open-chain acylacetonitrile couplers, etc., yellow couplers include acylacetamide couplers (e.g., benzoylacetanilides, pivaloylacetanilides, etc.), etc., and cyan couplers include naphtholic couplers, phenolic couplers, etc. Of these couplers, non-diffusible couplers having a hydrophobic group called ballast group or polymerized couplers are desirable. The couplers may be of either 4-equivalent type or 2-equivalent type based on silver ion. Colored couplers having color-correcting effect or couplers capable of releasing a development restrainer upon development (called DIR couplers) may also be used. In addition to DIR couplers, non-color forming DIR coupling compounds capable of forming a colorless coupling reaction product and releasing a development inhibitor may also be incorporated. In addition to the DIR couplers, those compounds which release a development restrainer upon development may also be incorporated.

Two or more of the above-described couplers or the like may be used in the same layer, or one and the same compound may be added to two or more different layers for obtaining characteristics required for light-sensitive materials.

In the present invention, the aforesaid dye-providing substance and the above-described couplers can be introduced into light-sensitive materials according to known methods described, for example, in U.S. Pat. No. 2,322,027.

For example, the dye-providing substance is dissolved in a high-boiling organic solvent such as an alkyl phthalate (e.g., dibutyl phthalate, dioctyl phthalate, etc.), a phosphate (diphenyl phosphate, triphenyl phosphate, tricresyl phosphate, dioctylbutyl phosphate, etc.), a citric ester (e.g., tributyl acetylcitrate), a benzoic ester (e.g., octyl benzoate), an alkylamide (e.g., diethyllaurylamide), a fatty acid ester (e.g., dibutoxyethyl succinate, diethyl azelate, etc.), a trimesic ester (e.g., tributyl trimesate), etc. or an organic solvent having a boiling point of from about 30° to about 150° C. such as a lower alkyl acetate (e.g., ethyl acetate, butyl acetate, etc.), ethyl propionate, secbutyl alcohol, methyl isobutyl ketone, β-ethoxyethyl acetate, methylcellosolve acetate, or the like, then the resulting solution is dispersed in a hydrophilic colloid. The above-described high-boiling organic solvents may be used in combination with the low-boiling organic solvents.

A method of dispersing the substance using a polymer described in Japanese Patent Publication No. 39853/76 and U.S. Pat. Nos. 4,199,363, 4,203,716, 4,214,047, 4,247,627, 4,304,769 and 4,512,969 may also be employed.

With couplers having an acidic group such as carboxylic acid or sulfonic acid group, they are introduced into the hydrophilic colloid as an alkaline aqueous solution.

The photographic light-sensitive material of the present invention may contain, in the photographic emulsion layer or other hydrophilic colloidal layer thereof, organic or inorganic hardeners. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and the like can be used alone or in combination.

Where dyes, ultraviolet ray absorbents, etc., are incorporated in hydrophilic colloidal layers of light-sensitive materials prepared according to the present invention, they may be mordanted with a cationic polymer or the like.

The light-sensitive material prepared according to the present invention may contain a hydroquinone derivative, an aminophenol derivative, a gallic acid derivative, an ascorbic acid derivative, etc., as a color fog-preventing agent.

The light-sensitive material prepared according to the present invention may contain in its hydrophilic colloidal layer an ultraviolet ray absorbent. For example, aryl group-substituted benzotriazole compounds (e.g., those described in U.S. Pat. No. 3,533,794), 4-thiazolidone compounds (e.g., those described in U.S. Pat. Nos. 3,214,794 and 3,352,681), benzophenone compounds (e.g., those described in Japanese Patent Application (OPI) No. 2784/71), cinnamic acid esters (e.g., those described in U.S. Pat. Nos. 3,705,805 and 3,707,375), butadiene compounds (e.g., those described in U.S. Pat. No. 4,405,229), or benzoxidol compounds (e.g., those described in U.S. Pat. No. 3,700,455). Further, UV ray-absorbing couplers (e.g., α-naphtholic cyan dye-forming couplers) or UV ray-absorbing polymers may also be used. These UV ray absorbents may be mordanted to a specific layer.

The light-sensitive material prepared according to the present invention may contain in its hydrophilic colloidal layers a water-soluble dye as a filter dye or for various purposes such as prevention of irradiation. Such dye includes oxonol dyes, hemioxonol dyes, styryl dyes, merocyanine dyes, cyanine dyes, and azo dyes. Of these, oxonol dyes, hemioxonol dyes, and merocyanine dyes are particularly useful.

In the practice of the present invention, the following known fading preventing agents can be used in combination. The color image-stabilizing agents to be used in the present invention may be used alone or in combination of two or more. The known fading preventing agents include, for example, hydroquinone derivatives, gallic acid derivatives, p-alkoxyphenols, p-oxyphenol, derivatives, bisphenols, and the like.

In applying the present invention to conventional silver halide photographic light-sensitive materials, any of known processes and known processing solutions described, for example, in *Research Disclosure*, RD No. 176, pp. 28–30 (December, 1978) may be employed. Such processing may be a photographic processing for forming a silver image (black-and-white processing) or a color photographic processing for forming a dye image (color photographic processing) depending upon the purpose. Processing temperature is usually selected between 18° and 50° C. However, temperatures lower than 18° C. or higher than 50° C. may be employed.

Formation of dye image may be conducted in a conventional manner. For example, a negative-positive process (described, for example, in *Journal of the Society of Motion Picture and Television Engineers*, Vol. 61, pp. 667–701 (1953); a color reversal process which comprises developing with a developer containing a black-and-white developing agent to form a negative silver image, then conducting at least once uniform exposure or other proper fogging processing, followed by conducting color development to obtain a dye positive image; a silver dye-bleach process which comprises developing an exposed dye-containing photographic emulsion layer to form a silver image, then bleaching dye using the silver image as a bleaching catalyst; and the like are employed.

Color developers generally comprise an alkaline aqueous solution containing a color developing agent. As the color developing agents, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.) may be used.

In addition, those described in L. F. A. Mason; *Photographic Processing Chemistry* (Focal Press, 1966), pp. 226–229, U.S. Pat. Nos. 2,193,015, 2,592,364, and 3,816,134, etc. may also be used.

Color developers may further contain pH buffers such as alkali metal sulfites, carbonates, borates, and phosphates, development restrainers or antifoggants such as bromides, iodides, and organic antifoggants and, if necessary, may contain hard water softeners, preservatives such as hydroxylamine, organic solvents such as benzyl alcohol and diethylene glycol, development accelerators such as polyethylene glycol, quaternary ammonium salts, and amines, dye-forming couplers, competitive couplers, fogging agents such as sodium borohydride, auxiliary developing agents such as 1-phenyl-3-pyrazolidone, viscosity-imparting agents, polycarboxylic acid type chelating agents, antioxidants, etc.

Color-developed photographic emulsion layers are usually bleached. Bleaching may be conducted separately or simultaneously with fixing. As bleaching agents, compounds of polyvalent metals such as iron(III), cobalt(III), chromium(VI), copper(II), etc., peracids, quinones, nitroso compounds, etc. are used.

For example, ferricyanates, dichromates, organic complex salts of iron(III) or cobalt(III) such as complex salts of aminopolycarboxylic acids (e.g., ethylenediaminetetraacetic acid, nitrilotriacetic acid, 1,3-diamino-2-propanol tetraacetic acid or organic acids (e.g., citric acid, tartaric acid, malic acid, etc.); persulfates and permanganates; nitrosophenol; etc. may be used. Of these, potassium ferricyanate, sodium ethylenediaminetetraacetato ferrate and ammonium ethylenediaminetetraacetato ferrate are particularly useful. Ethylenediaminetetraacetato ferrate is useful in both an independent bleaching solution and a mono-bath bleach-fixing solution.

As a fixing solution, those which have the same formulation as are ordinarily employed can be used. As a fixing agent, organic sulfur compounds which are known to function as fixing agents can be used as well as thiosulfates and thiocyanates. The fixing solution may contain a water-soluble aluminum salt as a hardener.

Developers to be used for black-and-white photographic processing may contain known developing agents. As the developing agents, dihydroxybenzenes (e.g., hydroquinone), 3-pyrazolidones (e.g., 1-phenyl-3-pyrazolidone), aminophenols (e.g., N-methyl-p-aminophenol), etc. may be used alone or in combination. In addition, the developer generally contains known additives such as a preservative, an alkali agent, a pH buffer, an antifogging agent and, if necessary, the developer may further contain a dissolving aid, a toning agent, a development accelerator, a surface active agent, a defoaming agent, a hard water softener, a hardener, a tackifier, etc.

So-called "lith-type" development processing may be applied to the photographic emulsion of the present invention. "Lith-type" development processing means a development processing usually using a dihydroxybenzene as a developing agent and conducting development in an infectious manner at a low sulfite ion concentration for photographically reproducing line images or halftone dot images. (Detailed descriptions are given in Mason, *Photographic Processing Chemistry*, (1966), pp. 163–165.)

The present invention is now illustrated in further detail by reference to the following examples which, however, are not to be construed as limiting the present invention in any way.

EXAMPLE 1

A first layer (lowermost layer) to a seventh layer (uppermost layer) were coated as described in Table 1 on a polyethylene-double laminated paper. Upon preparation, the amounts of the highly water-absorbing high molecular weight compounds of the present invention and gelatin were changed as shown in Table 2 to prepare color photographic light-sensitive materials A to C.

These samples were exposed to blue light through an optical wedge using a densitometer, then developed with the following processing solution. At the same time, unexposed samples were subjected to the same development processing.

| | |
|---|---|
| Developer | |
| Benzyl alcohol | 15 ml |
| Diethylenetriaminepentaacetic acid | 5 g |
| Kbr | 0.4 g |
| $Na_2SO_3$ | 5 g |
| $Na_2CO_3$ | 30 g |
| Hydroxylamine sulfate | 2 g |
| 4-Amino-3-methyl-N-β-(methanesulfonamide)ethylaniline.3/2$H_2SO_4$.$H_2O$ | 4.5 g |
| Water to make | 1,000 ml |
| pH 10.1 | |
| Bleach-fixing solution | |
| Ammonium thiosulfate (70 wt %) | 150 ml |
| $Na_2SO_3$ | 5 g |
| Na[Fe(EDTA)] | 40 g |
| EDTA | 4 g |
| Water to make | 1,000 ml |
| pH 6.8 | |

Processing steps

| | Temp. | Time |
|---|---|---|
| Developer | 33° C. | 3'30" |
| Bleach-fixing soln. | 33° C. | 1'30" |
| Washing with water | 28–35° C. | 3' |

In order to evaluate desilvering, the samples were exposed to light through a step wedge, then processed changing the blix (bleach-fix) time to 30 seconds.

TABLE 1

| | |
|---|---|
| Support: | Polyethylene-double laminated paper support |
| 1st layer: (Blue-sensitive layer) | Containing the following: Silver chlorobromide emulsion (Cl: 20 mol %; coated amount 400 mg of silver/$m^2$) |

TABLE 1-continued

| | |
|---|---|
| | Gelatin (coated amount: 700 mg/m$^2$)<br>Yellow coupler (*6)<br>(coated amount: 500 mg/m$^2$)<br>Coupler solvent (*7)<br>(coated amount: 400 mg/m$^2$) |
| 2nd layer: (Interlayer) | Gelatin (coated amount: 1,000 mg/m$^2$) |
| 3rd layer: (Green-sensitive layer) | Containing the following:<br>Silver chlorobromide emulsion<br>(Cl: 30 mol %; coated amount: 500 mg cf silver/m$^2$)<br>Gelatin (coated amount: 700 mg/m$^2$)<br>Magenta coupler (*4)<br>(coated amount: 400 mg/m$^2$)<br>Coupler solvent (*5)<br>(coated amount: 400 mg/m$^2$) |
| 4th layer: (Inter-layer) | Containing the following:<br>Gelatin (coated amount: 800 mg/m$^2$)<br>Ultraviolet ray absorbent (*3)<br>(coated amount: 1,600 mg/m$^2$)<br>Ultraviolet ray absorbent solvent (*2)<br>(coated amount: 300 mg/m$^2$) |
| 5th layer: (Red-sensitive layer) | Containing the following:<br>Silver chlorobromide emulsion<br>(Cl: 50 mol %; coated amount: 300 mg of silver/m$^2$)<br>Gelatin (coated amount: 500 mg/m$^2$)<br>Cyan coupler (*1)<br>(coated amount: 400 mg/m$^2$)<br>Coupler solvent (*2)<br>(coated amount: 300 mg/m$^2$) |
| 6th layer: (Interlayer) | Gelatin (coated amount: 800 mg/m$^2$)<br>Ultraviolet ray absorbent (*3)<br>(coated amount: 1,600 mg/m$^2$)<br>Ultraviolet ray absorbent solvent (*2)<br>(coated amount: 300 mg/m$^2$) |
| 7th layer: (Protective layer) | Gelatin (coated amount: 1,600 mg/m$^2$) |

(*1) Cyan coupler; 2-[α-(2,4-tert-pentylphenoxy)butane-amido-4,6-dichloro-5-methylphenol
(*2) Solvent; Dibutyl phthalate
(*3) Ultraviolet ray absorbent; 2-(2-Hydroxy-3-sec-butyl-5-tert-butylphenyl)benzotriazole
(*4) Magenta coupler; 1-(2,4,6-trichlorophenyl)-3-(2-chloro-5-tetradecanamido)anilino-5-pyrazolone
(*5) Solvent: Tricresyl phosphate
(*6) Yellow coupler: α-Pivaloyl-α-(2,4-dioxo-5,5'-dimethyl-oxazolidin-3-yl)-2-chloro-5-[α-(2,4-di-tert-pentylphenoxy)butanamido] acetanilide
(*7) Solvent: Dioctylbutyl phosphate

TABLE 2

| Light-sensitive Material | A (Comparative Example) Gelatin (g/m$^2$) | A P-1* (g/m$^2$) | B (Present Invention) Gelatin (g/m$^2$) | B P-1* (g/m$^2$) | C (Present Invention) Gelatin (g/m$^2$) | C P-1* (g/m$^2$) |
|---|---|---|---|---|---|---|
| 1st layer (Blue-sensitive layer) | 0.7 | 0 | 0.7 | 0 | 0.6 | 0.1 |
| 2nd layer (Interlayer) | 1 | 0 | 1.0 | 0 | 0.4 | 0.3 |
| 3rd layer (Green-sensitive layer) | 0.7 | 0 | 0.7 | 0 | 0.6 | 0.1 |
| 4th layer (Interlayer) | 0.8 | 0 | 0.8 | 0 | 0.3 | 0.2 |
| 5th layer (Red-sensitive layer) | 0.5 | 0 | 0.5 | 0 | 0.4 | 0.1 |
| 6th layer (Interlayer) | 0.8 | 0 | 0.8 | 0 | 0.3 | 0.2 |
| 7th layer (Protective layer) | 1.6 | 0 | 1.0 | 0.6 | 1.0 | 0.6 |
| Development Progress** | 0.41 | | 0.32 | | 0.29 | |
| Amount of residual Ag (Relative) | 1.00 | | 0.95 | | 0.90 | |

*Sumika Gel L-5(H)
**Yellow density differences between samples A to C color-developed for 3'30" after being wedge exposed to white light in an exposure amount which gave sample A a yellow density of fog + 1.0 by color-developing for 3'30" and similarly exposed samples A to C color-developed for 2'30" were employed as a scale for development progress.

Densities and amounts of residual silver of the developed samples were measured using a densitometer, FSD 103, made by Fuji Photo Film Co., Ltd. Results thus obtained are shown in Table 2.

It is apparent from the results that samples B and C prepared by adding the highly water-absorbing high molecular weight compound (Sumika Gel L-5(H)) to sample A underwent rapid development and desilvering.

EXAMPLE 2

Each of the following layers was coated on a cellulose triacetate support to prepare a multi-layered color light-sensitive material.

1st layer: Antihalation layer comprising gelatin containing black colloidal silver:

| | |
|---|---|
| Colloidal silver | 0.2 g/m$^2$ |
| Gelatin | 1.8 g/m$^2$ |

2nd layer: Interlayer comprising gelatin

| | |
|---|---|
| Gelatin | 1.5 g/m$^2$ |

3rd layer: First red-sensitive emulsion layer comprising a composition prepared by adsorbing sensitizing dyes I, II, and III on a silver iodobromide emulsion having an average grain size of 0.45 μm and containing 6 mol % of silver iodide, adding thereto 4-hydroxy-6-methyl-1,3,3a,7-tetrazaindene, then mixing with an emulsion dispersion of Couplers EC-1 and D.

| | |
|---|---|
| Silver halide | 2.1 g of Ag/m$^2$ |
| Gelatin | 2.8 g/m$^2$ |
| Sensitizing dye I | $6.2 \times 10^{-5}$ mol/mol Ag |
| Sensitizing dye II | $1.9 \times 10^{-4}$ mol/mol Ag |
| Sensitizing dye III | $1.7 \times 10^{-5}$ mol/mol Ag |
| Coupler EC-1 | 0.040 mol/mol Ag |
| Coupler D | 0.0034 mol/mol Ag |

Couplers EC-1 and D were used by dissolving in a mixed solvent of tricresyl phosphate and ethyl acetate, mixing the solution with a gelatin solution containing sodium di-(2-ethylhexyl)-α-sulfosuccinate, then emulsifying and dispersing the mixture through high-speed mechanical stirring.

4th layer: Second red-sensitive emulsion layer comprising a composition prepared by adsorbing sensitizing dyes I, II, and III on a silver iodobromide emulsion having an average grain size (diameter) of 0.7 μm and containing 8 mol % of silver iodide, adding thereto 4-hydroxy-6-methyl-1,3,3a,7-tetrazindene, then mixing with an emulsion dispersion of Couplers EC-1 and EC-2.

| | |
|---|---|
| Silver halide | 0.7 g of Ag/m$^2$ |
| Gelatin | 0.9 g/m$^2$ |
| Sensitizing dye I | $5.5 \times 10^{-5}$ mol/mol Ag |
| Sensitizing dye II | $1.7 \times 10^{-4}$ mol/mol Ag |
| Sensitizing dye III | $1.5 \times 10^{-5}$ mol/mol Ag |
| Coupler EC-1 | 0.021 mol/mol Ag |
| Coupler EC-2 | 0.007 mol/mol Ag |

The emulsion dispersion of Couplers EC-1 and EC-2 was prepared and added in the same manner as with the emulsion dispersion of the first red-sensitive layer to add.

5th layer: Gelatin interlayer containing an emulsion dispersion of 2,5-di-t-octylhydroquinone.

| | |
|---|---|
| 2,5-di-t-octylhydroquinone | 0.05 g/m$^2$ |
| Gelatin | 1.1 g/m$^2$ |

6th layer: First green-sensitive emulsion layer comprising a composition prepared by adsorbing sensitizing dyes IV and V on a silver iodobromide emulsion having an average grain size of 0.45 μm and containing 6 mol % of silver iodide, adding thereto 4-hydroxy-6-methyl-1,3,3a,7-tetrazaindene, then mixing with an emulsion dispersion of Couplers EM-1, EM-2, and D.

| | |
|---|---|
| Silver halide | 1.2 g of Ag/m$^2$ |
| Sensitizing dye IV | $5.2 \times 10^{-4}$ mol/mol Ag |
| Sensitizing dye V | $2.1 \times 10^{-4}$ mol/mol Ag |
| Coupler EM-1 | 0.067 mol/mol Ag |
| Coupler EM-2 | 0.018 mol/mol Ag |
| D | 0.0064 mol/mol Ag |

The emulsion dispersion of Couplers EM-1, EM-2, and D used above was prepared by dissolving them in a mixed solvent of tricresyl phosphate, dibutyl phthalate, and ethyl acetate, mixing the solution with a gelatin solution containing sodium dodecylbenzenesulfonate, then emulsifying and dispersing by high-speed mechanical stirring.

7th layer: Second green-sensitive emulsion layer comprising a composition prepared by adsorbing sensitizing dyes IV and V on a silver iodobromide emulsion having an average grain size of 0.75 μm and containing 7.5 mol % of silver iodide, adding thereto 4-hydroxy-6-methyl-1,3,3a,7-tetrazaindene, then mixing with an emulsion dispersion of Couplers EM-2, EM-3, and EM-4.

| | |
|---|---|
| Silver halide | 1.0 g of Ag/m$^2$ |
| Gelatin | 1.2 g/m$^2$ |
| Sensitizing dye IV | $3.1 \times 10^{-4}$ mol/mol Ag |
| Sensitizing dye V | $1.3 \times 10^{-4}$ mol/mol Ag |
| Coupler EM-2 | 0.0033 mol/mol Ag |
| Coupler EM-3 | 0.0096 mol/mol Ag |
| Coupler EM-4 | 0.0041 mol/mol Ag |

The emulsion of Couplers EM-2, EM-3, and EM-4 was prepared by emulsifying and dispersing in the same manner as with the couplers of the first green-sensitive layer, then added as described above.

8th layer: Interlayer containing an emulsion dispersion of yellow colloidal silver and 2,5-di-tertoctylhydroquinone.

| | |
|---|---|
| Colloidal silver | 0.12 g/m$^2$ |
| 2,5-di-t-octylhydroquinone | 0.10 g/m$^2$ |

9th layer: First blue-sensitive emulsion layer comprising a composition prepared by adding 4-hydroxy-6-methyl-1,3,3a,7-tetrazaindene to a silver iodobromide emulsion having an average grain size of 0.5 μm and containing 6.3 mol % of silver iodide, and mixing with an emulsion dispersion of Couplers EY-1 and D.

| | |
|---|---|
| Silver halide | 0.51 g of Ag/m$^2$ |
| Gelatin | 1.4 g/m$^2$ |
| Coupler EY-1 | 0.28 mol/mol Ag |
| Coupler D | 0.018 mol/mol Ag |

The emulsion dispersion of Couplers EY-1 and D was prepared by dissolving them in a mixed solvent of tricresyl phosphate and ethyl acetate, mixing the solution with a gelatin solution containing sodium dodecylbenzenesulfonate, then emulsifying and dispersing by high-speed mechanical stirring.

10th layer: Second blue-sensitive emulsion layer comprising a composition prepared by adsorbing sensitizing dye VI on a silver iodobromide emulsion having an average grain size of 0.75 μm and containing 8.5 mol % of silver iodide, adding thereto 4-hydroxy-6-methyl-1,3,3a,7-tetrazaindene, then mixing with an emulsion dispersion of Couplers EY-1 and D.

| | |
|---|---|
| Ag | 0.73 g/m$^2$ |
| Gelatin | 0.83 g/m$^2$ |
| Sensitizing dye VI | $1.9 \times 10^{-4}$ mol/mol Ag |
| Coupler EY-1 | 0.026 mol/mol Ag |
| Ccupler D | 0.010 mol/mol Ag |

The emulsion dispersion of Couplers EY-1 and D were prepared by emulsifying and dispersing in the same manner as with Couplers of the first blue-sensitive emulsion layer, and added as described before.

11th layer: Gelatin protective layer containing polymethyl methacrylate particles of 1.8 μm in average particle size

| | |
|---|---|
| Polymethyl methacrylate | 0.02 g/m$^2$ |
| Gelatin | 1.5 g/m$^2$ |

To each of the above-described 1st to 11th layers was added 2-hydroxy-4,6-dichloro-s-triazine sodium salt as a gelatin hardener, and the resulting solutions were coated by properly adding thereto a coating aid. The sample thus prepared was referred to as Sample a.

Coupler EM-1

-continued
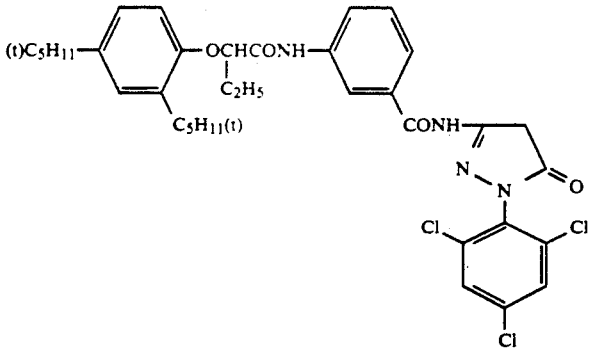
Coupler EM-2
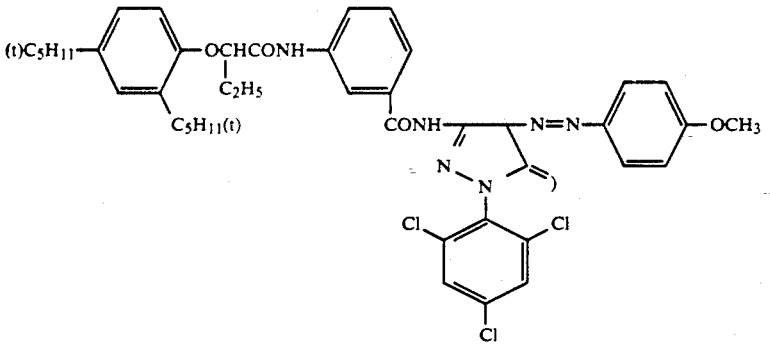
Coupler EM-3
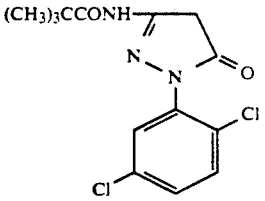
Coupler EM-4
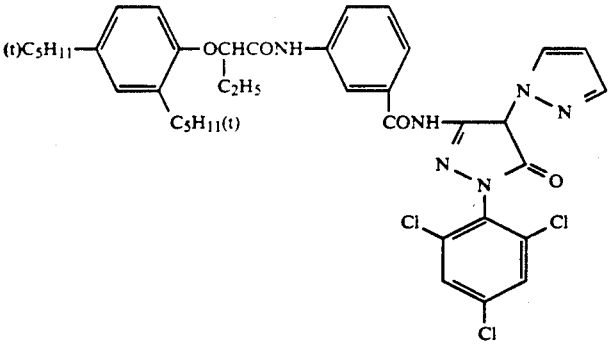
Coupler EC-1
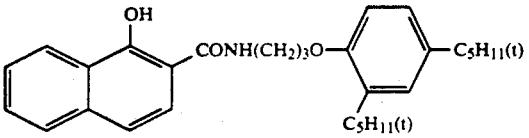
Coupler EC-2

-continued
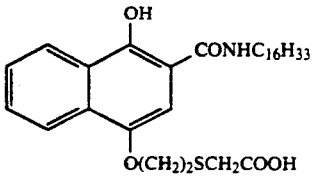
Sensitizing Dye-I
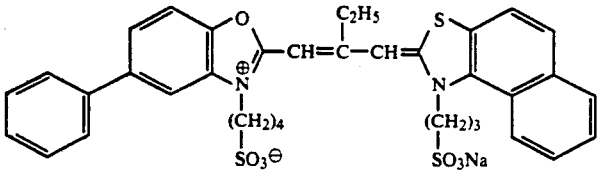
Sensitizing Dye-II
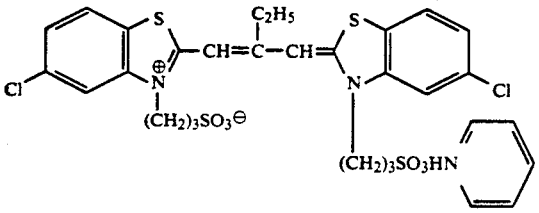
Sensitizing Dye-III
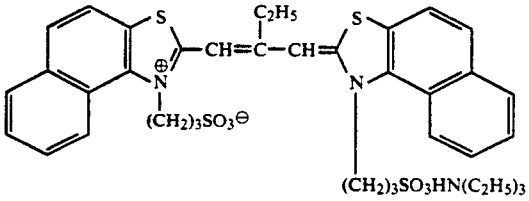
Sensitizing Dye-IV
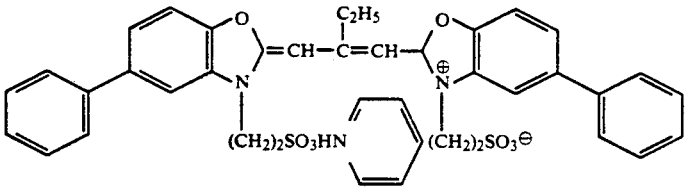
Sensitizing Dye-V
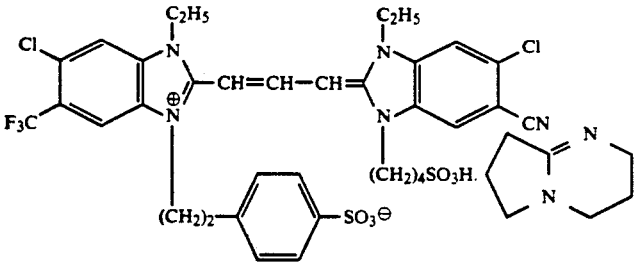
Sensitizing Dye-VI
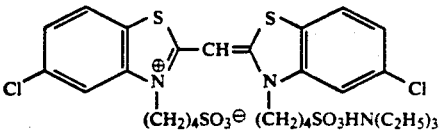
Coupler D -continued

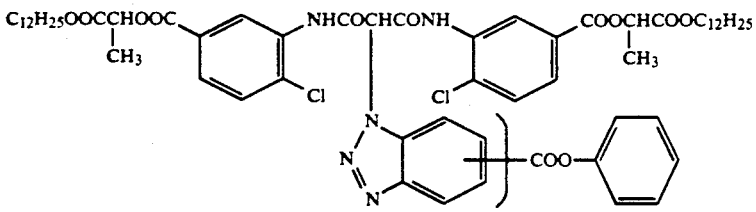

Coupler EY-1

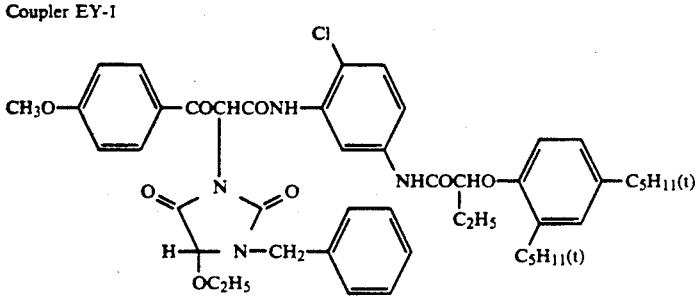

Development processing steps employed were as follows.

| | | |
|---|---|---|
| 1. Color development | 3'15" | (38° C.) |
| 2. Bleaching | 6'30" | |
| 3. Washing with water | 2'10" | |
| 4. Fixing | 4'20" | |
| 5. Washing with water | 3'15" | |
| 6. Stabilizing | 1'05" | |

Formulations of the processing solutions used in the above-described steps were as follows.

| | |
|---|---|
| Color developer | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2-methyl-aniline sulfate | 4.5 g |
| Water to make | 1 liter |
| Bleaching solution | |
| Ammonium bromide | 160.0 g |
| Aqueous ammonia (28%) | 25.0 ml |
| Sodium iron ethylenediamine-tetraacetate | 130 g |
| Glacial acetic acid | 14 ml |
| Water to make | 1 liter |
| Fixing solution | |
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |
| Stabilizing solution | |
| Formalin (37.5% formaldehyde solution) | 8.0 ml |
| Water to make | 1 liter |

Sample b was prepared in the same manner except for reducing the amount of gelatin used in the interlayer and protective layer of Sampe a as shown in Table 3, and using instead the highly water-absorbing high molecular weight compound as shown in Table 3.

TABLE 3

| | Amount of Coated Gelatin ($g/m^2$) | Highly Water-Absorbing High Polymer P-1*($g/m^2$) |
|---|---|---|
| 2nd layer (Interlayer) | 0.2 | 0.3 |
| 5th layer (Interlayer) | 0.2 | 0.3 |
| 8th layer (Interlayer) | 0.2 | 0.3 |
| 11th Layer (Protective layer) | 1.0 | 0.3 |

*Sumika Gel L-5(H)

As a scale for sharpness of image, a rectangular wave frequency number chart was printed on the samples, followed by the following processing to examine a response characteristic for a frequency number of 40 lines/nm ($D_G$=(Green Density) 1.0).

Results thus obtained are shown in Table 4. The higher the value, the higher the sharpness.

Similarly, yellow density difference between the samples a and b color-developed for 3'15" after being wedge exposed to 4,800° K. white light in an exposure amount which gave a yellow density of fog +1.2 to sample a by 3'15" color development, and similarly exposed samples a and b color developed for 2'35" were employed as a scale for development progress.

TABLE 4

| | Development Progress Y(3'15"-2'35") | Sharpness ($D_G$ = 1.0 40 lines/mm) |
|---|---|---|
| Sample a (comparative sample) | 0.24 | 0.6 |
| Sample b (present invention) | 0.16 | 0.7 |

It is apparent from the results given in Table 4 that Sample b containing highly water-absorbing high molecular weight compound P-1 in the interlayer or protective layer shows faster development progress and excellent sharpness in comparison with comparative Sample a.

EXAMPLE 3

A silver halide emulsion-layer of the following composition was coated on both sidde of a 180-μm thick polyethylene terephthalate film support subbed and a protective layer of the following composition was further coated thereon, then dried to prepare a black-and-white silver halide light-sensitive material.

Emulsion layer

Thickness: about 5 μm.

Composition:

A gelatino-silver iodobromide emulsion containing 1.5 mol % of silver iodide (average size of silver halide grains: 1.3 μm) was ripened by adding thereto 0.6 mg of chloroauric acid and 3.4 mg of sodium thiosulfate per mol of silver halide, and heated at 60° C. for 50 minutes. To the thus obtained emulsion was added 4-hydroxy-6-methyl-1,3,3a, 7-tetrazaindene as a stabilizer.

Protective layer

Thickness: about 1 μm.

Composition and coating amounts are shown in Table 5.

TABLE 5

| Composition | Sample: Comparative Sample | Sample: Sample of the Present Invention |
|---|---|---|
| Gelatin | 1.0 g/m$^2$ | 0.5 g/m$^2$ |
| Highly water-absorbing high molecular weight compound, P-1 | — | 0.5 g/m$^2$ |
| $C_{12}H_{25}$—O—($CH_2$—$CH_2$—O)$_{10}$H | 60 mg/m$^2$ | 60 mg/m$^2$ |
| 2,6-dichloro-6-hydroxy-1,3,5-triazine Na salt | 10 mg/m$^2$ | 10 mg/m$^2$ |

P-1: Sumika Gel L-5(H)

Each sample was exposed to a tungsten lamp light through a filter, SP-14, made by Fuji Photo Film Co., Ltd., then developed for 90 seconds in an automatic developer, Fuji RN (made by Fuji Photo Film Co., Ltd.), using RD-III (made by Fuji Photo Film Co., Ltd.) as a developer to examine photographic properties. The results shown in Table 6.

TABLE 6

| Sample | Photographic Sensitivity (Relative) | Maximum Density | Gradation |
|---|---|---|---|
| Comparative Sample | 70 | 3.1 | 2.5 |
| Present Invention | 100 | 3.5 | 2.7 |

It is seen that the sample of the present invention is excellent with all properties.

EXAMPLE 4

Each sample was prepared in the same manner as described in Example 3 except for replacing 20 wt % of gelatin in the emulsion layer by the highly water-absorbing high molecular weight compound, P-1 (0.5 g/m$^2$), and processed in the same manner as described in Example 3.

The results are shown in Table 7.

TABLE 7

| Sample | Photographic Sensitivity (Relative) | Maximum Density | Gradation |
|---|---|---|---|
| Comparative Sample | 65 | 3.1 | 2.5 |
| Present Invention | 100 | 3.7 | 2.8 |

It is seen that the highly water-absorbing high molecular weight compound can improve all properties when added to either of the emulsion layer and the protective layer. The same effects was obtained by adding the compound to both of the layers.

EXAMPLE 5

An emulsion of benzotriazole silver salt was prepared as follows.

20 g of gelatin and 13.2 f of benzotriazole were dissolved in 300 ml of water. This solution was kept at 40° C. and stirred. A solution of 17 g of silver nitrate in 100 ml of water was added to the solution in 2 minutes.

pH of this emulsion of benzotriazole silver salt was adjusted to flocculate and remove excess salts. Then, pH was adjusted to 6.30 to obtain 400 g of an emulsion of benzotriazole silver salt.

A silver halide emulsion for the 5th and the 1st layers was prepared as follows.

600 ml of an aqueous solution containing sodium chloride and potassium bromide and an aqueous solution of silver nitrate (prepared by dissolving 0.59 mol of silver nitrate in 600 ml of water) were simultaneously added at an equal flow rate to a well stirred gelatin aqueous solution (containing 20 g of gelatin and 3 g of sodium chloride in 1000 ml of water, and kept at 75° C.) over 40 minutes. Thus, a mono-disperse cubic silver chlorobromide emulsion (bromide: 50 mol % of 0.40 μm in average grain size was prepared.

After washing with water and removing salts, 5 mg of sodium thiosulfate and 20 mg of 4-hydroxy-6-methyl-1,3,3a, 7-tetrazaindene were added thereto to conduct chemical sensitization at 60° C. Thus, 600 g of an emulsion was obtained.

A silver halide emulsion for the 3rd layer was prepared as follows.

600 ml of an aqueous solution containing sodium chloride and potassium bromide and an aqueous solution of silver nitrate (prepared by dissolving 0.59 mol of silver nitrate in 600 ml of water) were simultaneously added at an equal flow rate to a well stirred gelatin aqueous solution (contained 20 g of gelatin and 3 g of sodium chloride in 1000 ml of water, and kept at 75° C.) over 40 minutes. Thus, a mono-disperse cubic silver chlorobromide emulsion (bromide: 80 mole %) of 0.35 μm in average grain size was prepared.

After washing with water and removing salts, 5 mg of sodium thiosulfate and 20 mg of 4-hydroxy-6-methyl-1,3,3a,7-tetrazaindene were added thereto to conduct chemical sensitization at 60° C. Thus, 600 g of an emulsion was obtained.

A gelatin dispersion of dye-providing substance was prepared as follows.

5 g of yellow dye-providing substance (A), 0.5 g of sodium 2-ethyl-hexyl sulfosuccinate as a surfactant, and 10 g of triisononyl phosphate were weighed, and 30 ml of ethyl acetate was added thereto, followed by heating to about 60° C. to prepare a uniform solution. This solution was stirred and mixed with 100 g of a 10% lime-processed gelating solution, then subjected to a homogenizer for 10 minutes at 10,000 rpm to disperse. This dispersion is referred to as a yellow dye-providing substance dispersion.

A magenta dye-providing substance dispersion was prepared in the same manner as described above except for usng magenta dye-providing substance (B) and using 7.5 g of tricresyl phosphate as a high-boiling solvent.

A cyan dye-providing substance dispersion was prepared in the same manner as with the yellow dye-providing substance dispersion using cyan dye-providing substance (C).

A multi-layered color light-sensitive material having the layer structure as shown in Table 8 was prepared using them.

Dye-providing substance:

Dye Providing Substance (A)

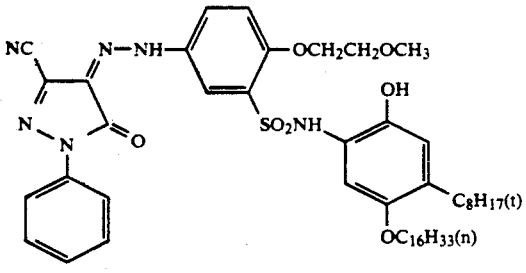

Dye providing Substance (B)

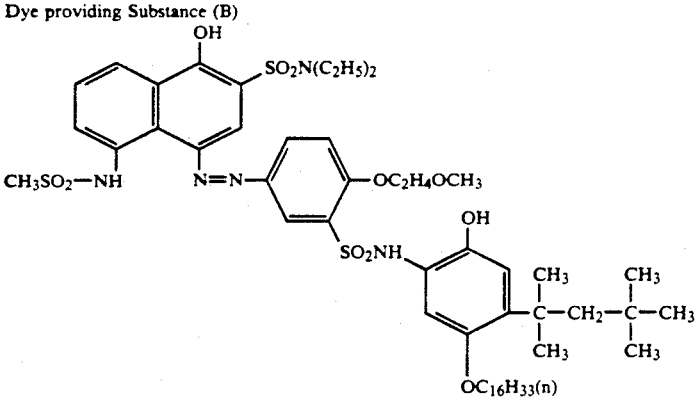

Dye Providing Substance (C)

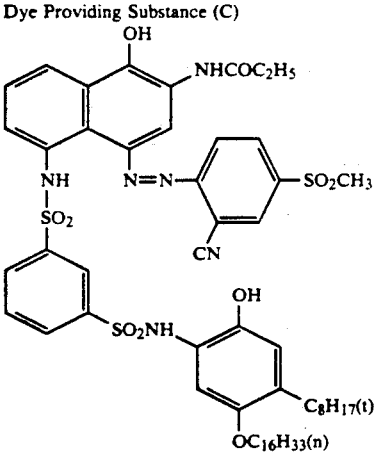

TABLE 8

| | |
|---|---|
| 6th layer: | Gelatin (coated amount: 1000 mg/m$^2$) |
| | Base precursor*3 (coated amount: 600 mg/m$^2$) |
| | Silica*5 (coated amount: 100 mg/m$^2$) |
| 5th layer: Green sensitive emulsion layer | AgClBr emulsion (Br: 50 mol %; coated amount: 400 mg of Ag/m$^2$) |
| | Benzenesulfonamide (coated amount: 180 mg/m$^2$) |
| | Benzotriazole silver salt emulsion (coated amount: 100 mg/m$^2$) |
| | Sensitizing dye D-1 (coated amount: $10^{-6}$ mol/m$^2$) |
| | Base precursor*3 (coated amount: 500 mg/m$^2$) |
| | Yellow dye-providing substance (A) |
| | (coated amount: 400 mg/m$^2$) |
| | Gelatin (coated amount: 1000 mg/m$^2$) |
| | High-boiling solvent*4 (coated amount: 800 mg/m$^2$) |
| | Surfactant*2 (coated amount: 100 mg/m$^2$) |
| 4th layer: Interlayer | Gelatin (coated amount: 1200 mg/m$^2$) |
| | Base precursor*3 (coated amount: 600 mg/m$^2$) |
| 3rd layer: Red-sensitive emulsion layer | AgClBr emulsion (Br: 80 mol %; coated amount: 300 mg of Ag/m$^2$) |
| | Benzenesulfonamide (coated amount: 180 mg/m$^2$) |
| | Benzotriazole silver salt emulsion (coated amount: 100 mg of Ag/m$^2$) |
| | Sensitizing dye D-2 (coated amount: $8 \times 10^{-7}$ mol/m$^2$) |
| | Base precursor*3 (coated amount: 450 mg/m$^2$) |
| | Magenta dye-providing substance (B) (coated amount: 400 mg/m$^2$) |
| | Gelatin (coated amount: 1000 mg/m$^2$) |
| | High-boiling solvent*1 (coated amount: 600 mg/m$^2$) |

TABLE 8-continued

| | |
|---|---|
| | Surfactant*2 (coated amount 100 mg/m$^2$) |
| 2nd layer: | Gelatin (coated amount: 1000 mg/m$^2$) |
| Interlayer | Base precursor*3 (coated amount: 600 mg/m$^2$) |
| 1st layer: | AgClBr emulsion (Br: 50 mol %; |
| Infrared | coated amount: 300 mg of Ag/m$^2$) |
| light- | Benzenesulfonamide (coated amount: 180 mg/m$^2$) |
| sensitive | Benzotriazole silver salt emulsion |
| emulsion | (coated amount: 100 mg of Ag/m$^2$) |
| layer | Sensitizing dye D-3 |
| | (coated amount: $10^{-5}$ mol/m$^2$) |
| | Base precursor*3 (coated amount: 500 mg/m$^2$) |
| | Cyan dye-providing substance (C) |
| | (coated amount: 300 mg/m$^2$) |
| | Gelatin (coated amount: 1000 mg/m$^2$) |
| | High-boiling solvent*4 |
| | (coated amount: 600 mg/m$^2$) |
| | Surfactant*2 (coated amount: 100 mg/m$^2$) |
| Support: | Polyethylene terephthalate |

*1tricresyl phosphate;

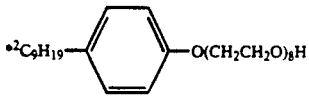

*3guanidine salt of $CH_3CONH$— 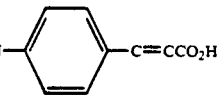 —$C{=}CCO_2H$

*4$(iso\text{-}C_9H_{19}O)_3P{=}O$
*5size: 4 μm

A dye-fixing material was prepared as follows.

On a paper support laminated with polyethylene containing dispersed therein titanium dioxide were coated the subbing layer and the dye-fixing layer in sequence as shown in Table 9 and dried, followed by heating to 90° C. for 20 minutes to prepare dye-fixing materials R-1 to R-6. The amount of water necessary for maximally swelling the coating film of each material, and the amount of water absorbed by each material after dipping it in water for 1, 2, or 4 seconds in water and squeezing away water depositing on the surface by means of rollers were examined.

Then, the color light-sensitive material having the aforesaid layer structure was exposed for one second at 500 lux using a tungsten lamp through G, R, IR-three color separation filters having a continuously changing density (G: constituted by 500–600 nm band passes filter; R: 600 to 700 nm band pass filter; IR: filter passing 700 nm or longer band).

Then, the same sample was heated for 30 seconds on a 140° C. heat block.

Thereafter, each of the aforesaid dye-fixing materials was dipped in water for 1 second and, after squeezing away water deposting on the surface using rollers, superposed on the light-sensitive material with the coating side facing each other. The assembly was heated for 6 seconds on a 80° C. heat block. Upon peeling the dye-fixing material apart from the light-sensitive material, yellow, magenta, and cyan color images were obtained on the fixing material corresponding to the G, B, and Ir three color separation filters. Maximum densities of respective colors were measured using a Macbeth reflection densitometer (RD-519), and transfer unevenness were examines. Results are shown in Table 9.

It is seen from Table 9 that the transfer process using the dye-fixing material of the present invention can provide a high-density transfer image with no transfer unevenness by short-time water absorption.

TABLE 9

(Unit of coated amount: g/m$^2$)

| Formulation | R-1 (Comparison) | R-2 (Present Invention) | R-3 (Present Invention) | R-4 (Present Invention) | R-5 (Present Invention) | R-6 (Present Invention) |
|---|---|---|---|---|---|---|
| Protective layer | | | | | | |
| Lime-processed gelatin | — | — | — | — | 0.5 | — |
| Highly water-absorbing high molecular weight compound, P-1 | — | — | — | — | 0.5 | — |
| Crosslinking agent | — | — | — | — | C*3 0.01 | — |
| Dye-fixing layer | | | | | | |
| Lime-processed gelatin | 4 | — | 2 | 4 | 2 | 2 |
| Mordant D*4 | 4 | 3.5 | 3.5 | 4 | 3.5 | 3.4 |
| Highly water-absorbing high molecular weight compound, P-1 | — | 2.5 | 2 | — | 2 | 2 |
| Crosslinking agent | — | B*2 0.003 | B*2 0.002 | C*3 0.002 | B*2 0.003 | 0.003 |
| Subbing layer | | | | | | |
| Lime-processed gelatin | 2 | — | 1 | — | 0.5 | 0.8 |
| Highly water-absorbing high molecular compound, P-1 | — | — | — | 1 | — | 0.8 |
| Crosslinking agent | A*1 0.2 | | A*1 0.2 | B*2 0.002 | A*2 0.15 | C*3 0.02<br>B*2 0.001 |
| Support | Polyethylene terephthalate containing dispersed therein $TiO_2$ (White base) | | | | | |
| Amount of water necessary for maximum swelling | 16 g/m$^2$ | 36 g/m$^2$ | 25 g/m$^2$ | 29 g/m$^2$ | 32 g/m$^2$ | 34 g/m$^2$ |
| Amount of water absorbed (g/m$^2$) | 1" 2" 4"<br>2 4 12 | 1" 2" 4"<br>31 34 36 | 1" 2" 4"<br>19 23 24 | 1" 2" 4"<br>11 15 20 | 1" 2" 4"<br>23 27 29 | 1" 2" 4"<br>25 29 32 |
| Dmax | | | | | | |
| Cyan | 0.35 | 2.10 | 2.02 | 1.35 | 2.05 | 2.08 |
| Magenta | 0.42 | 2.33 | 2.25 | 1.60 | 2.28 | 2.30 |
| Yellow | 0.45 | 2.25 | 2.18 | 1.52 | 2.25 | 2.27 |

TABLE 9-continued (Unit of coated amount: g/m²)

| Formulation | R-1 (Comparison) | R-2 (Present Invention) | R-3 (Present Invention) | R-4 (Present Invention) | R-5 (Present Invention) | R-6 (Present Invention) |
|---|---|---|---|---|---|---|
| Transfer unevenness | serious | none | none | none | none | none |

*1 $CH{=}CHSO_2CH_2CH_2CONH(CH_2)_2NHCOCH_2SO_2{-}CH{=}CH_2$
*2 Ethyleneglycol diglycidyl ether
*3 Formaldehyde
P-1: Sumika Gel L-5(H)
*4

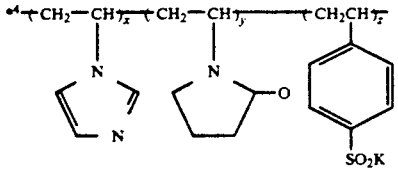

While the present invention has been described in detail and with reference to specific embodiments thereof, it is apparent to one skilled in the art that various changes and modifications can be made therein without departing from the spirit and scope of the present invention.

What is claimed is:

1. A silver halide photographic light-sensitive material comprising a support and at least one silver halide emulsion layer, wherein at least one layer of said silver halide photographic light-sensitive material contains a highly water-absorbing high molecular weight compound having a degree of swelling for water of 5 or more in an amount sufficient to accelerate time of development processing and/or dye transfer, wherein the highly water-absorbing high molecular weight compound is a saponified product of a copolymer composed of at least one vinyl ester and ethylenically unsaturated carboxylic acid or derivatives thereof, or a hydrolyzate of an acrylonitrile type polymer.

2. A silver halide photographic light-sensitive material as in claim 1, wherein said material further comprises a dye providing layer, and wherein said layer of said silver halide photographic light-sensitive material containing a highly water-absorbing high molecular weight compound is said dye providing layer.

3. A silver halide photographic light-sensitive material as in claim 1, wherein the highly water-absorbing high molecular weight compound has a degree of swelling for water of 10 or more.

4. A silver halide photographic light-sensitive material as in claim 3, wherein the molar ratio of vinyl ester component to ethylenically unsaturated carboxylic acid component is from 20/80 to 80/20.

5. A silver halide photographic light-sensitive material as in claim 4, wherein the molar ratio of vinyl ester component to ethylenically unsaturated carboxylic acid component in the highly water-absorbing high molecular weight compound is from 30/70 to 70/30.

6. A silver halide photographic light-sensitive material as in claim 4, wherein the molar ratio of vinyl ester component to ethylenically unsaturated carboxylic acid component in the highly water-absorbing high molecular weight compound is from 40/60 to 60/40.

7. A silver halide photographic light-sensitive material as in claim 1, wherein the highly water-absorbing high molecular weight compound is a hydrolyzate of an acrylonitrile type polymer wherein the content of skeletal acrylonitrile is 30 wt % or more.

8. A silver halide photographic light-sensitive material as in claim 7, wherein the content of skeletal acrylonitrile in the hydrolyzate of an acrylonitrile type polymer is 50 wt % or more.

9. A silver halide photographic light-sensitive material as in claim 1, wherein the highly water-absorbing high molecular weight compound forms a coating layer that is crosslinked or cured after coating.

10. A silver halide photographic light-sensitive material as in claim 1, wherein the highly water-absorbing high molecular weight compound is used in an amount of from 0.1 to 20 g per m² of the support.

11. A silver halide photographic light-sensitive material as in claim 1, wherein the highly water-absorbing high molecular weight compound is used in an amount of from 0.5 to 5 g per m² of the support.

12. A silver halide photographic light-sensitive material as in claim 1, wherein the light-sensitive material is a silver halide color photographic material and the highly water-absorbing high molecular weight compound is present in an interlayer of said material.

13. A silver halide photographic light-sensitive material as in claim 1, wherein the layer containing the highly water-absorbing high molecular weight compound is the silver halide emulsion layer.

14. A silver halide photographic light-sensitive material as in claim 1, wherein the layer containing the highly water-absorbing high molecular weight compound is the coating layer.

15. A silver halide photographic light-sensitive material as in claim 1, wherein the layer containing the highly water-absorbing high molecular weight compound is an interlayer.

16. A silver halide photographic light-sensitive material as in claim 1, wherein the highly water-absorbing high molecular weight compound is contained in more than one layer.

* * * * *